US005521626A

United States Patent [19]

Tanaka et al.

[11] Patent Number: 5,521,626

[45] Date of Patent: May 28, 1996

[54] FUSION-TYPE THERMAL TRANSFER PRINTING SYSTEM

[75] Inventors: Hideshi Tanaka, Yokohama; Yoshiro Hakamada, Noda, both of Japan

[73] Assignee: Victor Company of Japan, Ltd., Yokohama, Japan

[21] Appl. No.: 134,812

[22] Filed: Oct. 12, 1993

[30] Foreign Application Priority Data

| | | | |
|---|---|---|---|
| Oct. 12, 1992 | [JP] | Japan | 4-299201 |
| Feb. 4, 1993 | [JP] | Japan | 5-040567 |
| Apr. 22, 1993 | [JP] | Japan | 5-118959 |

[51] Int. Cl.[6] ..... B41J 2/325

[52] U.S. Cl. ..... 347/183; 347/217; 347/221; 347/211; 347/176

[58] Field of Search ..... 347/183, 197, 347/172, 174, 176, 211, 209, 210, 217, 221; 400/120.07, 120.16, 120.06, 240, 240.3, 240.4

[56] References Cited

U.S. PATENT DOCUMENTS 4,809,021 2/1989 Check et al. ..... 347/183

*Primary Examiner*—Huan H. Tran

*Attorney, Agent, or Firm*—Jacobson, Price, Holman & Stern

[57] ABSTRACT

A fusion-type thermal transfer printing system using an ink ribbon having a thin film and a heat fusible ink applied on the thin film at an ink application rate of 2.5 g/m$^2$ or less and a porous-surface recording medium having a substrate and a porous-surface layer formed on the substrate, diameters of pores in the porous-surface layer being from 1 to 10 μm. The printing system has a thermal head provided with a plurality of heating resistors formed in a line at regular intervals of 8 dot/mm or less, temperature gradient of each of the heated heating resistors being such that temperature is the highest at a middle portion thereof and changes decreasingly toward ends thereof and a gradation control circuit for controlling ink fusion areas heated by the heating resistors by controlling intensity of current passed through the thermal head. The ink of the ink ribbon is brought into tight contact with the porous-surface layer of the porous-surface recording medium and the thermal head is urged from the thin film side of the ink ribbon. A multi-gradation image can be obtained on the porous-surface recording medium by controlling the ink fusion areas under control of the gradation control circuit.

15 Claims, 16 Drawing Sheets

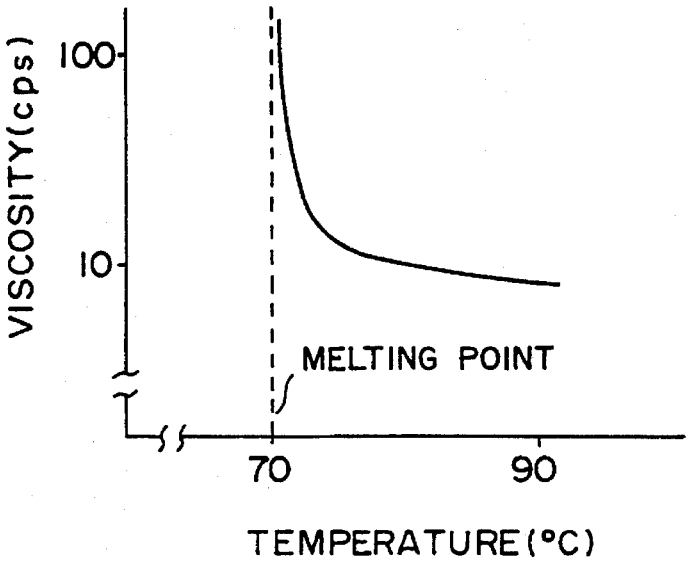
FIG. 3
FIG. 4A
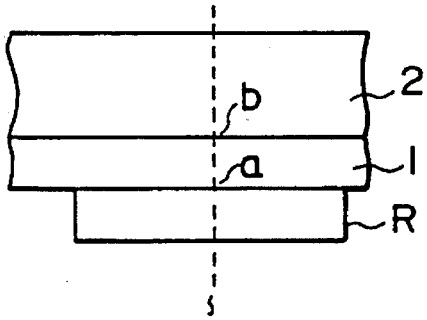
FIG. 4B
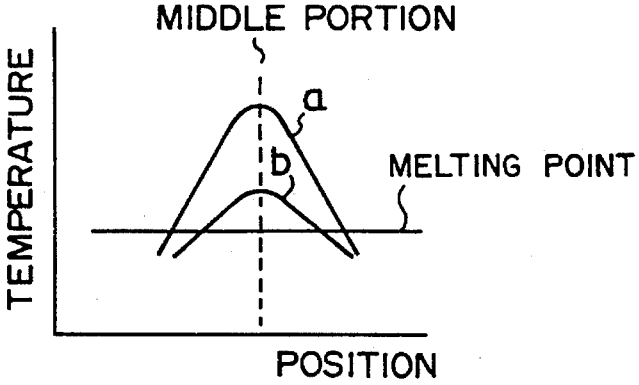

FIG.5A
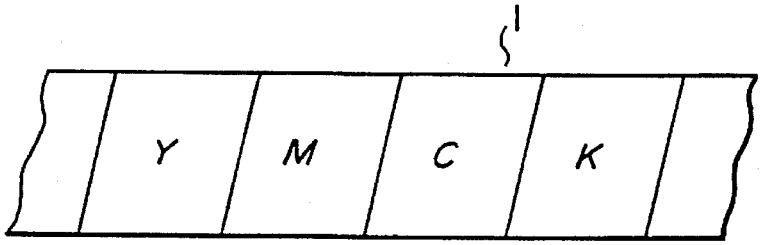
FIG.5B
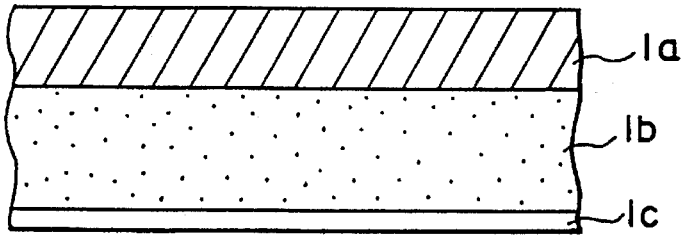
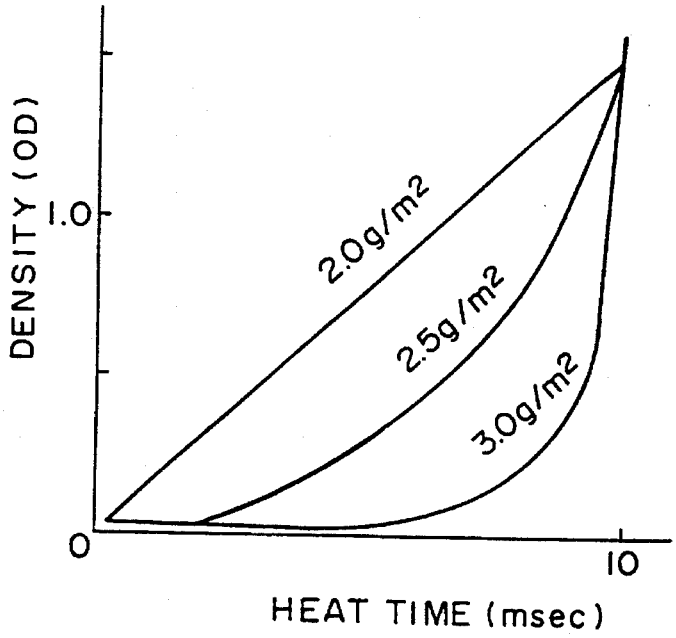
FIG.6

(4TH GRADATION)

Di
D1
D2
D3
D4
Dn-i
Dn
D1
D2

ST
GRADATION "4"
"5"

Ci
1 0 0 0 1 1
1 0

CK

LD

SB

1st GR
2nd GR
3rd GR
4th GR
(m-1)th GR
mth GR

Di
DI~Dn

ST
"1"
"2"
"3"
"4"
"m-1"
"m"

Ci
1111···11
1110···11
1100···11
1000···11
1000···10
1000···00

LD tR1 tR2 tR3 tR4 tRn-1 tRn

FUSION-TYPE THERMAL TRANSFER PRINTING SYSTEM

BACKGROUND OF THE INVENTION

1. Field of the Invention

The present invention relates to a fusion-type thermal transfer printing system for realizing multi-gradation printing with the use of at least one hot-melt ink.

2. Description of the Prior Art

When multi-gradation printing is effected with the use of a heat fusible ink, in general, a dither method of using a plurality of pixels (matrix) or a heat concentration method of using a special thermal head with small heating elements have been so far adopted.

In the conventional fusion-type thermal transfer printing systems, however, there exist problems in that in the case of the method of using a plurality of pixels, the resolution is deteriorated and therefore the image quality is degraded markedly; and in the case of the method of using the special thermal head, the cost of the printing system is inevitably high.

SUMMARY OF THE INVENTION

With these problems in mind, therefore, it is the object of the present invention to provide a fusion-type thermal transfer printing system by which multi-gradation images can be obtained at high resolution and in high quality with the use of a thermal head usable for the ordinary thermal transfer printing apparatus, To achieve the above-mentioned object, the present invention provides a fusion-type thermal transfer printing system, comprising: an ink ribbon having a thin film and a heat fusible ink applied on the thin film at an ink application rate of 2.5 g/m$^2$ or less; a porous-surface recording medium having a substrate and a porous-surface layer formed on the substrate, diameters of pores in the porous-surface layer being from 1 to 10 μm; a thermal head provided with a plurality of heating resistors formed in a line at regular intervals of 8 dot/mm or less, temperature gradient of each of the heated heating resistors being such that temperature is the highest at a middle portion thereof and changes decreasingly toward ends thereof; and a gradation control circuit for controlling ink fusion areas heated by the heating resistors by controlling intensity of current passed through said thermal head, wherein a multi-gradation image is obtained on said porous-surface recording medium by bringing the ink of said ink ribbon into tight contact with the porous-surface layer of said porous-surface recording medium, by urging said thermal head from the thin film side of said ink ribbon, and by controlling the ink fusion areas by said gradation control circuit.

Further, the present invention provides a fusion-type thermal transfer printing system, comprising: an ink ribbon having a thin film and a heat fusible ink applied on the thin film at an ink application rate of 2.5 g/m$^2$ or less; a porous-surface recording medium having a substrate and a porous-surface layer formed on the substrate, diameters of pores in the porous-surface layer being from 1 to 10 μm; a thermal head provided with a plurality of heating resistors having glazed portions and formed in a line at regular intervals of 8 dot/mm or less, temperature gradient of each of the heated heating resistors being such that temperature is the highest at a middle portion thereof and changes decreasingly toward ends thereof; a platen roller for sandwiching said ink ribbon and said porous-surface recording medium in cooperation with said thermal head; urging means for urging said thermal head against said platen roller under a predetermined pressure; and a gradation control circuit for controlling ink fusion areas heated by the heating resistors by controlling intensity of current passed through said thermal head, wherein a multi-gradation image is obtained on said porous-surface recording medium by bringing the ink of said ink ribbon into tight contact with the porous-surface layer of said porous-surface recording medium; by urging said thermal head from the thin film side of said ink ribbon with said urging means under a force per unit printing length of 0.35 kg/cm or more; and by controlling the ink fusion areas of the heating resistors under control of said gradation control circuit so that the ink permeates into the porous-surface layer of said porous-surface recording medium.

Furthermore, the present invention provides a fusion-type thermal transfer printing system, having: an ink ribbon having a thin film and a heat fusible ink mixed with a paint and a heat fusible binder and applied on the thin film at an ink application rate of 2.5 g/m$^2$ or less, a particle diameter of the paint being $\Phi$ and an ink thickness being T; a porous-surface recording medium having a substrate and a porous-surface layer formed with a great number of pores and formed on the substrate, a diameter of the pores in the porous-surface layer being k; a thermal head provided with a plurality of heating resistors formed in a line, temperature gradient of each of the heated heating resistors being such that temperature is the highest at a middle portion thereof and changes decreasingly toward ends thereof; and a gradation control circuit for controlling ink fusion areas heated by the heating resistors by controlling intensity of current passed through said thermal head, wherein a multi-gradation image is obtained on said porous-surface recording medium by bringing the ink of said ink ribbon into tight contact with the porous-surface layer of said porous-surface recording medium, by urging said thermal head from the thin film side of said ink ribbon, and by controlling the ink fusion areas by said gradation control circuit, and the relationship among the diameter k of the pores in the porous-surface of said porous-surface recording medium, the diameter $\Phi$ of particles in the paint of said ink ribbon, and the thickness T of the applied ink is $$\Phi \leqq k \leqq 4T$$

BRIEF DESCRIPTION OF THE DRAWINGS

FIG. 3 is a graphical representation showing the relationship between ink temperature and ink viscosity of the ink ribbon used for the printing system of the present invention;

FIG. 4A is a partial enlarged cross-sectional view of an ink ribbon and its adjoining things for assistance in explaining the printing system according to the present invention;

FIG. 4B is a graphical representation showing the temperature distributions at points a and b in FIG. 4A;

FIGS. 5A and 5B are perspective and cross-sectional views showing an ink ribbon used for the printing system according to the present invention;

FIG. 6 is a graphical representation showing the relationship between the heating time and the ink density the ink ribbon, which is obtained when the quantity of applied ink is changed.

DETAILED DESCRIPTION OF THE PREFERRED EMBODIMENTS

The embodiment of the fusion-type thermal transfer printing system according to the present invention will be described hereinbelow with reference to the attached drawings.

The present invention provides a fusion-type thermal transfer printing system by which multi-gradation images can be obtained at high resolution and in high quality with the use of a thermal head usable for the ordinary thermal transfer printing apparatus. The present invention can be realized by investigating various elements of the printing system such as thermal head, ink ribbon, recording paper, heat control method, etc. form various points of view.

Figure 1:
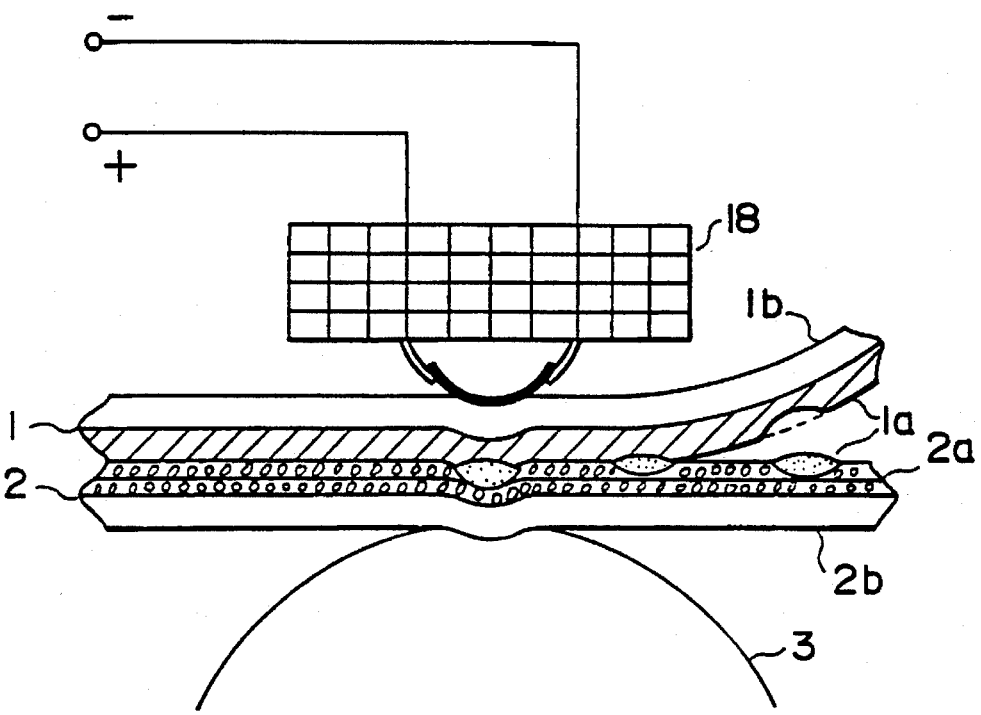
FIG. 1 is an enlarged view showing an essential portion of the printing system according to the present invention.

In the fusion-type thermal transfer printing system of the present invention, as shown in FIG. 1, ink 1*a* on an ink ribbon 1 is transferred into a porous-surface recording layer 2, by moving the stacked porous-surface recording medium 2 (described later) and the ink ribbon 1 sandwiched together between a platen roller 3 and a thermal head 18; by pushing the thermal head 18 against the platen roller 3; and further by heating resistors of the thermal head 18.

Figure 2:
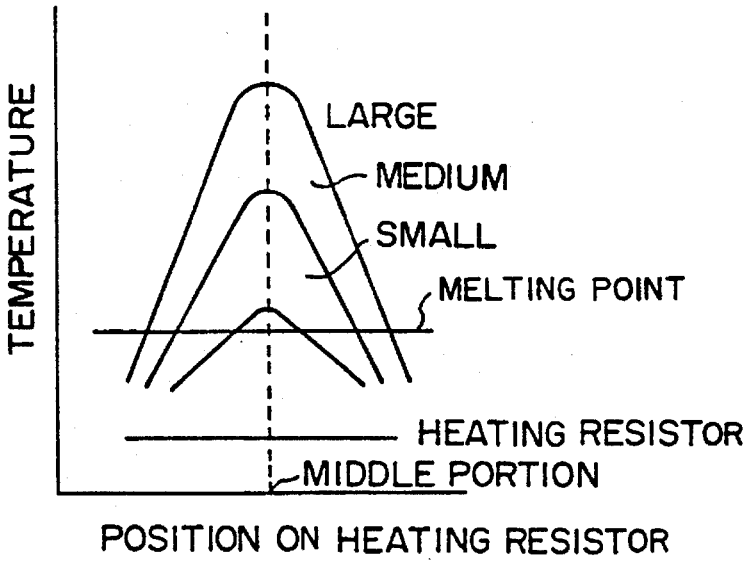
FIG. 2 is a graphical representation showing the temperature distributions of a heating resistor of the thermal head.

First, the principle of multi-gradation representation (recording or printing) with the use of a heat fusible ink will be described hereinbelow. FIG. 2 shows three temperature distributions on the heating resistor of the thermal head 18, which are obtained when one heating resistor is heated by three different (large, medium and small) quantities of heat. As shown, the temperature of the heating resistor is the highest at the middle portion on the heating resistor, and changes decreasingly with a temperature gradient toward the ends thereof. Further, the ink is fused at the positions of the heating resistor where the temperature rises beyond the melting point of the ink. Therefore, it is possible to control the fusion area of the ink on the basis of the temperature gradient.

Further, as shown in FIG. 3, the viscosity of the ink 1*a* on the ink ribbon 1 usually decreases with increasing temperature of the ink within the range beyond the melting point of the ink. Therefore, when the ink as described above is used, the ink viscosity becomes low at the middle portion of the heating resistor and high near the end portions thereof in accordance with the temperature distribution on the heating resistor as shown in FIG. 2. Accordingly, the quantity of ink permeated into the porous-surface recording medium 2 changes accordingly in such a way as to increase toward the middle portion of the heating resistor and decrease toward the end portions thereof. In other words, it is possible to facilitate the multi-gradation representation by controlling current to be passed through the heating resistor of the thermal head 18 according to the representation gradation (the gradation number), because the quantity of ink permeation and the area of ink permeation can be both controlled simultaneously.

As described above, in the fusion-type thermal transfer printing system of the present invention, as shown in FIG. 4A, the porous-surface recording medium 2 and the ink ribbon 1 are brought into pressure contact with the heating resistors R of the thermal head 18, and the heating resistors are heated to transfer the ink 1*a* on the ink ribbon 1 onto the porous-surface recording medium 2. FIG. 4B shows the temperature distributions at a point a (the surface of the heating resistor) and a point b (the surface of the recording medium) both shown in FIG. 4A. The temperature at the surface point b of the recording medium 2 changes according to the thickness of the ink ribbon 1. That is, the temperature at the surface point b becomes closer to the temperature distribution on the heating resistor with decreasing thickness of the ink ribbon 1. In other words, since the temperature gradient with respect to the position of the heating resistor at the surface point b becomes increasingly sharp with the decreasing thickness of the ink ribbon-1, the ink fusion area can be controlled more easily. Accordingly, it is preferable to reduce the thickness of the ink ribbon 1. However, since the practical lower limit of the film of the ink ribbon 1 is about 3.5 μm, in general a thin film with a thickness of 3.5 μm is used for the ink ribbon 1 of the present embodiment. The thickness of the ink ribbon 1 is determined practically by this film and the ink applied thereon. Accordingly, it is possible to bring the surface temperature distribution of the recording paper near the temperature distribution of the heating resistor by decreasing the amount of ink to be applied onto the film.

FIGS. 5A and 5B show an ink ribbon 1 used for the fusion-type thermal transfer printing system according to the present invention, in which FIG. 5A is a perspective view thereof and FIG. 5B is a cross-sectional view thereof. As shown in FIG. 5A, an ink 1*a* composed of a set of plural colors (e.g., yellow (Y), magenta (M), cyan (C) and black (K)) is applied continuously onto the ink ribbon 1 in the longitudinal direction thereof. Here, the ink can be formed by mixing the paint and a heat fusible binder. Further, as shown in FIG. 5B, in the ink ribbon 1, the heat fusible ink 1*a* is applied onto a thin film 1*b* (e.g., 3.5 μm thick) having a back coat 1*c* (e.g., 0.05 μm thick). FIG. 6 shows the relationship between the heating time (msec) of the ink ribbon (an ink is applied onto a film of 3.5 μm thick ) and the ink density (OD) on the recording paper, in which the quantity of ink applied onto the film is 2.0, 2.5 and 3.0 g/m$^2$ respectively In the conventional ribbon, an ink of 3.0 g/m$^2$ is applied onto a film with a thickness of 3.5 μm, for instance. In this embodiment, however, it has been clarified that the multi-gradation can be realized by reducing the quantity of ink applied onto the film down to 2.5 g/m$^2$. Further, in this embodiment, although the film thickness is 3.5 μm, it has been confirmed that there exists no problem as far as the film thickness is 4.0 μm or less.

Figure 7:
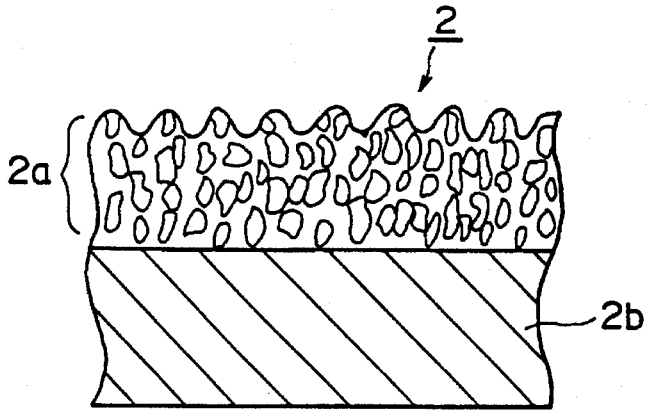
FIG. 7 is an enlarged cross-sectional view showing the porous-surface recording medium used fop the printing system according to the present invention.

Further, the ink transfer characteristics have been studied by using a porous-surface recording medium as the recording medium. The porous-surface recording medium 2 used with the printing system according to the present invention is a porous-surface plastic sheet as shown in FIG. 7, in which a porous-surface layer 2*a* with a thickness of about ten and several μm, for instance, is formed on a substrate 2*b*. Further, it has been confirmed that when a heat fusible ink 1*a* is transferred onto this porous-surface recording medium 2, the ink 1*a* can be transferred and further absorbed into the pores formed on the porous-surface layer 2*a*, as far as the surface roughness (pore diameters) of the porous-surface layer 2*a* satisfies a predetermined condition, so that the porous-surface recording medium 2 is most suitable for the multi-gradation representation.

Figure 8:
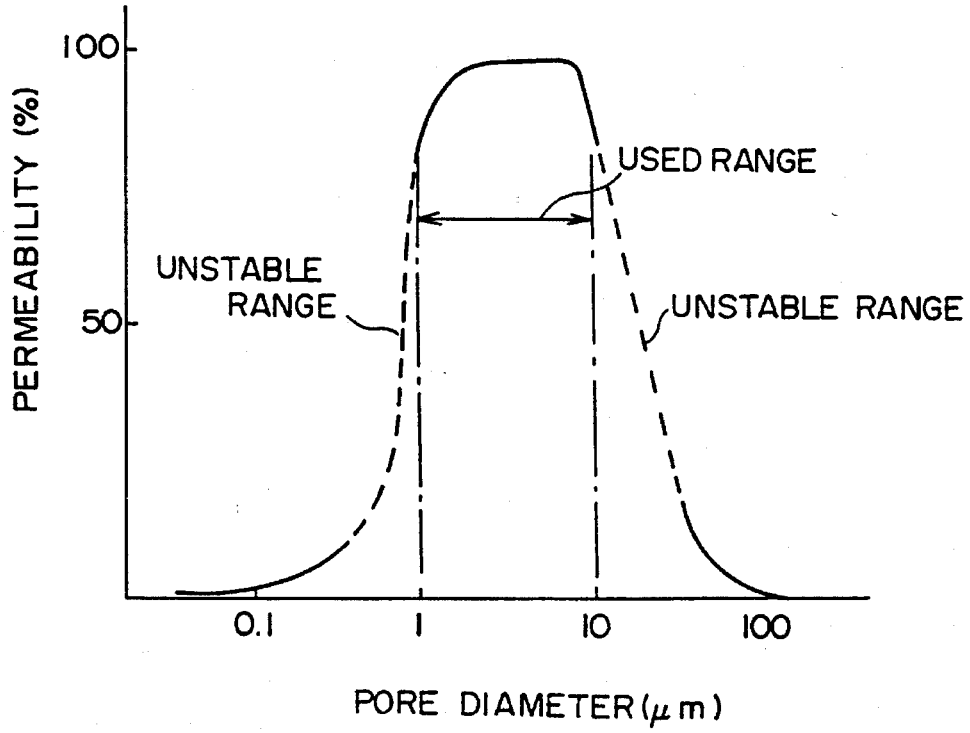
FIG. 8 is a graphical representation showing the relationship between the pore diameter of the porous-surface layer and the ink permeability.
Figure 9A:
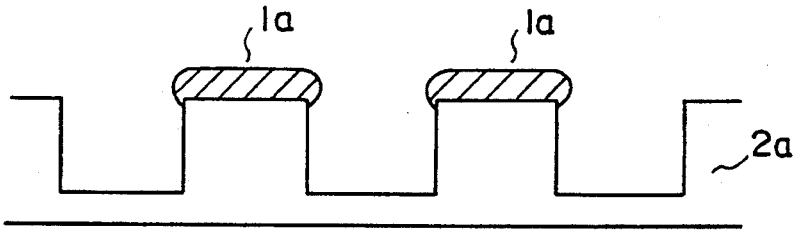
FIGS. 9A to 9C are illustrations for assistance in explaining the states where ink is transferred into the porous-surface layers of various different pore diameters.
Figure 9B:
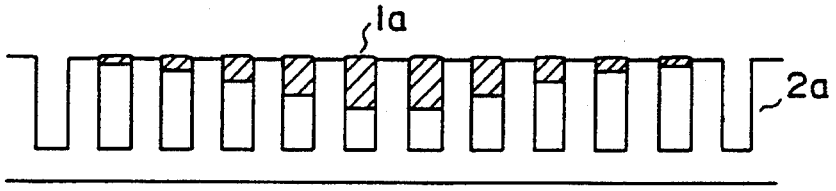
Figure 9C:
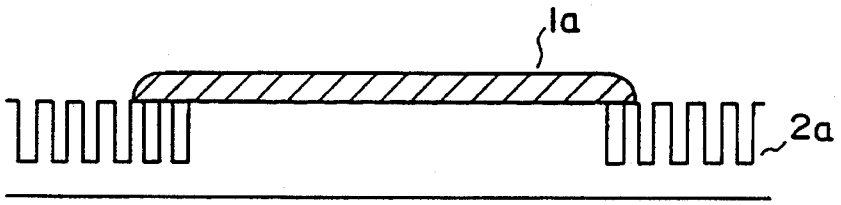

FIG. 8 shows the relationship between the diameters of pores in the porous-surface layer 2*a* and the permeability of the ink 1*a*. FIG. 8 indicates that an excellent result can be obtained when the pore diameters of the porous-surface layer 2*a* range from 1 to 10 μm. FIGS. 9A to 9C show the respective ink transfer states where the pore diameters are more than 1 to 10 μm, between 1 and 10 μm, and less than 1 to 10 μm, respectively. When the pore diameters are more than 1 to 10 μm, as shown in FIG. 9A, ink 1*a* hardly enters the pore portions, so that the ink is transferred only onto the surface of the porous-surface layer 2*a*. Under these conditions, since the ink 1*a* is not transferred into the pores but only onto the surface (top portions) of the layer 2*a* with a constant thickness, the ink adhesion is unstable and therefore easily broken off. Further, when a plurality of inks 1*a* are required to be transferred in sequence, mal-transfer easily occurs due to the influence of the thickness of the ink already transferred. In contrast with this, when the pore diameters are less than 1 to 10 μm, as shown in FIG. 9C, the ink 1*a* hardly enters the pore portions in the same way, so that the ink is transferred only onto the surface of the porous-surface layer 2*a*. In this case, the ink adhesion is also unstable particularly when a plurality of inks are transferred. Accordingly, under these conditions, since the ink 1*a* with a constant thickness is transferred in an unstable condition, it is difficult to realize an accurate multi-gradation recording.

On the other hand, when the pore diameter is between 1 and 10 μm, as shown in FIG. 9B, the heated and fused ink 1*a* can be transferred into the pore portions of the porous-surface layer 2*a*. In this case, the ink 1*a* is transferred much on the position corresponding to the middle portion of the heating resistor of the thermal head 18, and the ink 1*a* is transferred less on the positions corresponding to both end (low temperature) portions of the heating resistor thereof. Further, when a plurality of inks 1*a* are transferred, since the succeeding ink 1*a* can be transferred onto the already transferred ink under stacked condition, the ink transfer is stable. Consequently, since the quantity of ink to be transferred can be determined by the heating temperature of the ink 1*a*, it is possible to easily realize the multi-gradation recording. Further, the above-mentioned porous-surface recording medium (porous surface plastic sheet) is now on the market under the name of PEACH COAT (Trademark) by NISSINBO INDUSTRIES, INC. Japan.

Figure 10A:
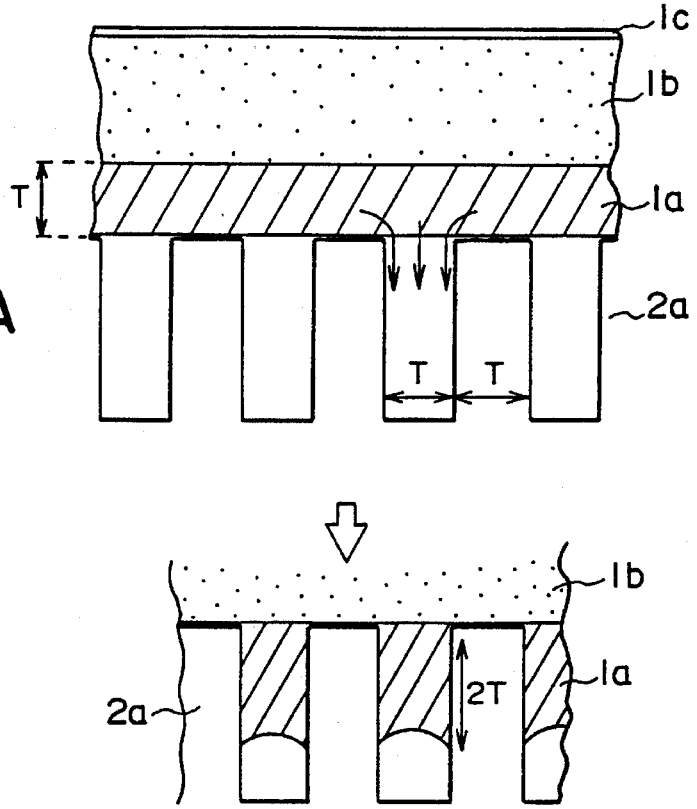
FIGS. 10A and 10B are illustrations for assistance in explaining the relationship among the pore diameter of the porous-surface layer of the recording medium, the paint particle diameter of the ink ribbon, and the ink application thickness of the ink ribbon.
Figure 10B:
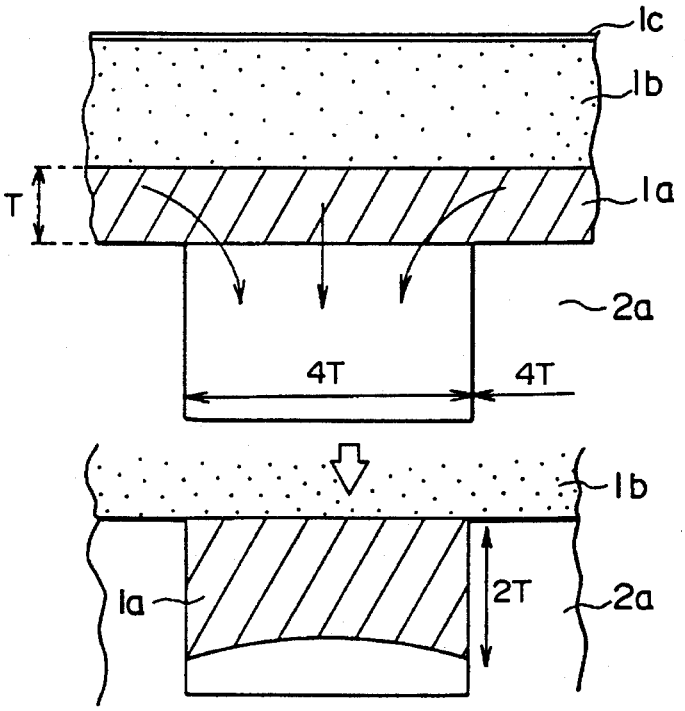

Further, the pore diameter of the porous-surface layer 2*a* of the recording medium 2 will be further studied hereinbelow from the different points of view. Here, the pore diameter of the porous-surface layer 2*a* is represented by k; the particle diameter of the paint of the ink 1*a* on the ink ribbon 1 is represented by Φ; and the thickness of the ink applied onto the ink ribbon 1 is represented by T. Further, the assumption is made that as shown in FIG. 10A, the pore diameter k is equal to the ink application thickness T and further the pores of the porous-surface layer 2*a* are arranged at regular intervals. Under the condition that the fused ink 1*a* completely enters all the pores of the porous-surface layer 2*a* due to capillary phenomenon, ink columns with a depth 2T are formed at the pores, respectively. Therefore, if the quantity of ink 1*a* applied onto the thin film 1*b* is 2.0 g/m$^2$ (= about 2.0 μm thick), the depth of the ink column is about 4 μm. Under these conditions, since the ink 1*a* in each pore is in contact with the thin film 1*b* at the area of each pore diameter k=T and further there exists an inner pore wall in contact with the ink 1*a* on the thin film 1*b*, the ratio of adhesive force of the ink 1*a* in contact with the thin film 1*b* to the adhesive force of the ink 1*a* in contact with the inner pore wall is 1:4. Accordingly, the ink 1*a* can be peeled off from the thin film 1*b* and thereby transferred into the pores of the porous-surface layer Further, as shown in FIG. 10B, in the case where the pore diameter k is 4 times of the ink application thickness T and further the pores of the porous-surface layer 2*a* are arranged at regular intervals, when the fused ink 1*a* completely enters all the pores of the porous-surface layer 2*a* due to capillary phenomenon, ink columns with a depth 2T can be formed at the pores, respectively. Therefore, if the quantity of ink application is 2.0 g/m$^2$ (= about 2.0 μm thick), the depth of the ink column is about 4 μm. Under these conditions, however, since the ink 1*a* in each pore is in contact with the thin film 1*b* at the area of each pore diameter k=4T and further there exists an inner pore wall in contact with the ink 1*a* on the thin film 1*b*, the ratio of adhesive force of the ink 1*a* in contact with the thin film 1*b* to the adhesive force of the ink 1*a* in contact with the inner pore wall is 1:1. In this case, however, since the fused ink is cooled beginning from the side of the porous-surface recording medium 2 (which is away from the heating source), when the ink ribbon 1 is separated away from the porous-surface recording medium 2 immediately after having been heated by the thermal head 18, the ink 1*a* can be peeled off from the thin film 1*b* and thereby transferred into the pores of the porous-surface layer 2*a*, because the adhesive force on the pore side is stronger than that on the ribbon side.

Further, under due consideration of the fact that even the fused ink 1*a* will not enter the pores whose diameters k is smaller than the particle diameter Φ of the paint of the ink 1*a* on the ink ribbon 1 in addition to the above-mentioned results, it is possible to transfer the ink into the pores of the recording medium 2 effectively under excellent condition according to the quantity of heat applied to the ink 1*a*, as far as the following relationship can be satisfied:

$$\Phi \leqq k \leqq 4T$$

where Φ denotes the particle diameter of the paint on the ink ribbon 1, k denoted the pore diameter of the porous-surface layer 2*a* on the recording medium 2, and T denotes the thickness of the ink 1*a* applied onto the ink ribbon 1.

As described above, when the porous-surface recording medium 2 is used; the ink 1*a* on the ink ribbon 1 is brought into tight contact with the porous-surface layer 2*a* of the recording medium 2; the thermal head 18 is urged against the platen roller 18 from the side of the film 1*b* of the ink ribbon 1; the intensity of current passed through the thermal head 18 is controlled; and further the temperature gradient of the heating resistors is utilized, experiments indicate that the fused ink 1*a* can be transferred and further absorbed from the ink ribbon 1 onto the surface of the recording medium 2 easily and immediately according to the quantity of heat generated by the thermal head 18, so that it is possible to obtain multi-gradation images of high resolution and high image quality.

Figure 11:
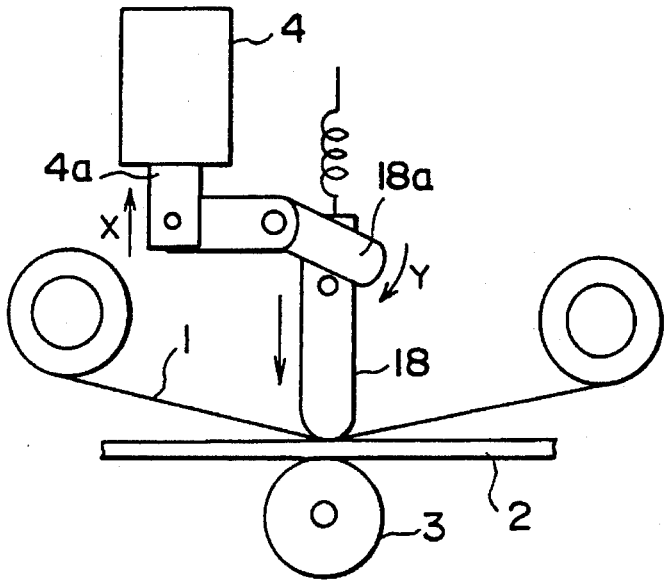
FIG. 11 is a side view showing an example of the essential urging means of the printing system according to the present invention.

Here, if the urging force of the thermal head 18 against the platen roller 3 is too small, there exists a case where the ink 1*a* is not sufficiently transferred and absorbed into the pore portions of the porous-surface recording medium 2 and therefore remains on the surface of the recording medium 2. FIG. 11 shows a mechanism for overcoming the problem as described above. In FIG. 11, the ink ribbon 1 and the porous-surface recording medium 2 are urged against the platen roller 3 by the thermal head 18 actuated by a plunger (urging means) 4. When a voltage is applied to the plunger 4, a joint axle 4*a* is raised upward in the arrow direction X, so that a joint 18*a* is pivoted clockwise in the direction Y. Therefore, the thermal head 18 is urged against the platen roller 3 with the ink ribbon 1 and the porous-surface recording medium sandwiched between the thermal head 18 and the platen roller 3. As described above, when a predetermined pressure is applied onto the ink ribbon 1 to transfer the ink onto the porous-surface recording medium 2, experiments indicate that the ink 1*a* can be transferred onto the surface of the recording medium 2 securely, so that it is possible to obtain multi-gradation images of extremely high resolution and image quality.

Figure 12:
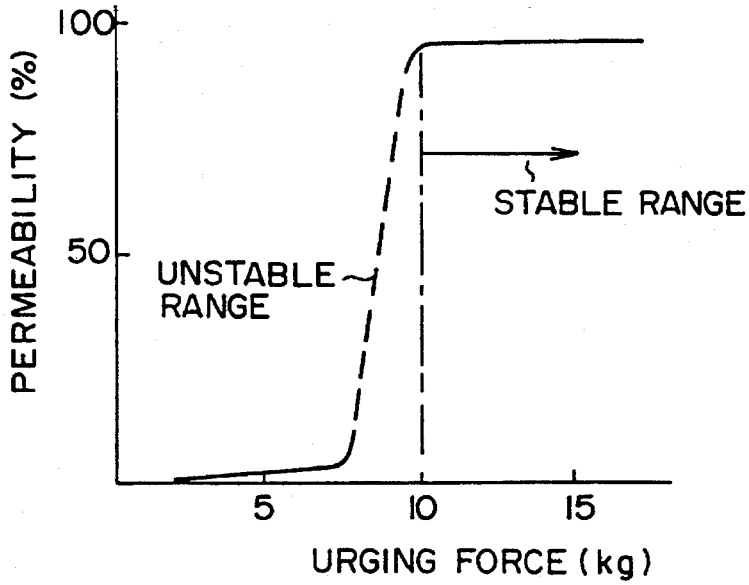
FIG. 12 is a graphical representation showing the relationship between the urging force by the urging means and the permeability of the ink into the porous-surface recording medium.

FIG. 12 shows the relationship between the urging force (kg) of the urging means and the permeability (%) of the ink to the porous-surface recording medium 2. The experiment results are obtained under the conditions that the film thickness of the ink ribbon 1 is 3.5 μm; the quantity of ink application is 2.0 g/cm$^2$; the pore diameters of the porous-surface recording medium 2 are 1 to 10 μm; the printing length of the thermal head 18 is 260 mm (26 cm); the intervals of the heating resistors of the thermal head are 84.5 μm (12 dot/mm); and the shape of the heating resistors is formed by partially glazed (thick film) resister material.

In the conventional printing system, the urging force of the thermal head at the above-mentioned printing length is usually from 4 to 6 kg. With reference to FIG. 12, it has been confirmed that when the urging force is less than 8 kg, the transfer is not stable and therefore ink is transferred only onto the surface of the recording medium; when about 9 kg, the ink 1*a* permeates slightly; and when more than 10 kg, the ink 1*a* permeates excellently. Since 9 kg /26 cm is 0.346 . . . kg/cm, it is considered that an excellent transfer result can be obtained when the urging force per unit printing length of the thermal head 18 is 0.35 kg/cm.

Figure 13:
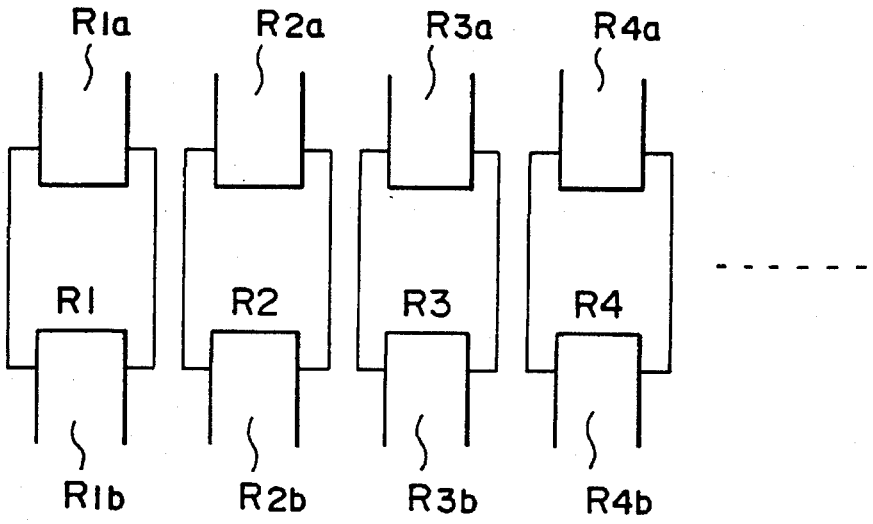
FIG. 13 is an enlarged partial view showing the heating elements (resistors) of the thermal head.
Figure 14A:
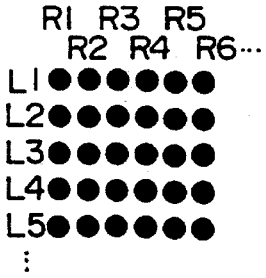
FIGS. 14A to 14C are illustrations showing heating patterns of the printing system according to the present invention.
Figure 14B:
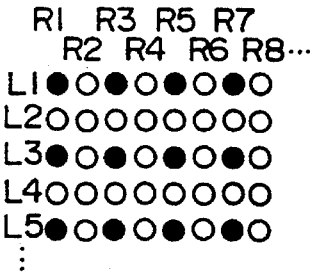
Figure 14C:
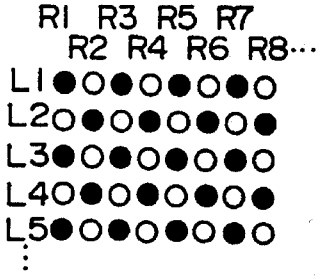

FIG. 13 is an enlarged view showing the heating resistors of the thermal head 18, in which square-shaped heating resistors R1 to R4 are arranged in a line and provided with electrodes R1*a* to R4*a* and R1*b* to R4*b*, respectively. The number n of the heating resistors R1 to Rn arranged in a horizontal line is 512, for instance; and using this thermal head 18, a number (480 for instance) of lines L1, L3, . . . are vertically printed line by line. In FIGS. 14A to 14C, the heated resistors for printing are represented by black circles; and the non-heated resistors for non-printing are represented by white circles. FIG. 14A shows the all dot printing in which all the heating resistors are heated; FIG. 14B shows the alternate printing in both horizontal and vertical directions in which the heating resistors R1, R3, R5 . . . are heated alternately alone the horizontal direction and further the heating resistors L1, L2, L3, . . . are heated alternately in the vertical direction; and FIG. 14C shows the cross-alternate printing in which the heating resistors R1, R3, R5, . . . are heated alternately in the horizontal direction in the lines L1, L3, L5, . . . , respectively, and also the heating resistors RE, R4, R6, . . . are heated alternately in the horizontal direction in the lines L2, L4, L6, . . . , respectively.

Figure 15:
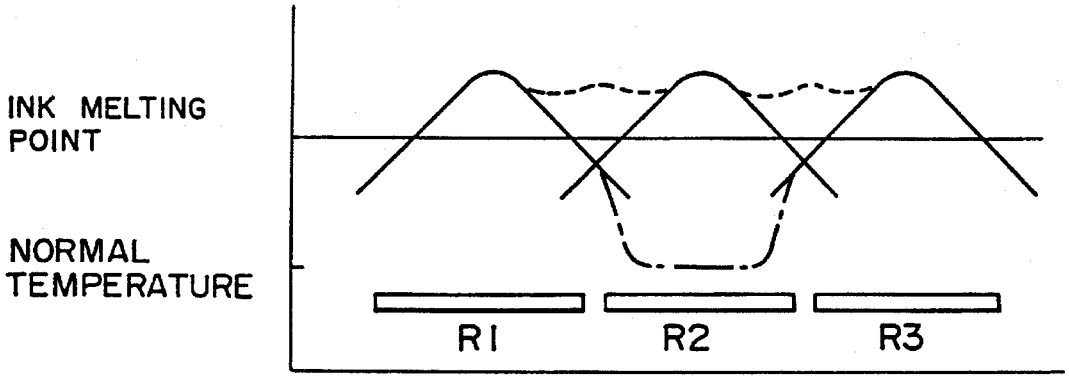
FIG. 15 is an illustration for assistance in explaining the temperature distributions of the heating resistors in both the whole printing method and the alternate printing method.

FIG. 15 shows the temperature distributions of the three heating resistors R1, R2 and R3, which indicates that each heating resistor has a temperature gradient highest at the middle thereof and changes decreasingly toward both the ends thereof. Here, when the three heating resistors R1, R2 and R3 are all heated simultaneously, since the temperature distribution curves at the interface between the two adjacent heating resistors are added as shown by the dashed lines, the interface is not well distinguishable. On the other hand, when the heating resistors R1 and R3 are heated without heating the heating resistor R2, the temperature distribution curves at the interface therebetween become as shown by the dot-dashed lines. In this case, since the heating resistor R2 serves as a cooling element for the two adjacent heated heating resistors R1 and R3, the temperature gradient becomes more distinguishable. On the basis of the above-mentioned feature, the same applicant has already proposed that the above-mentioned alternate printing is necessary to obtain multi-gradation images by the fusion-type thermal transfer printing system (in Japanese Patent Application No. 4-176166). Therefore, it has been confirmed that the above-mentioned alternate printing is necessary even when the porous-surface recording medium is used as the recording medium.

Figure 16A:
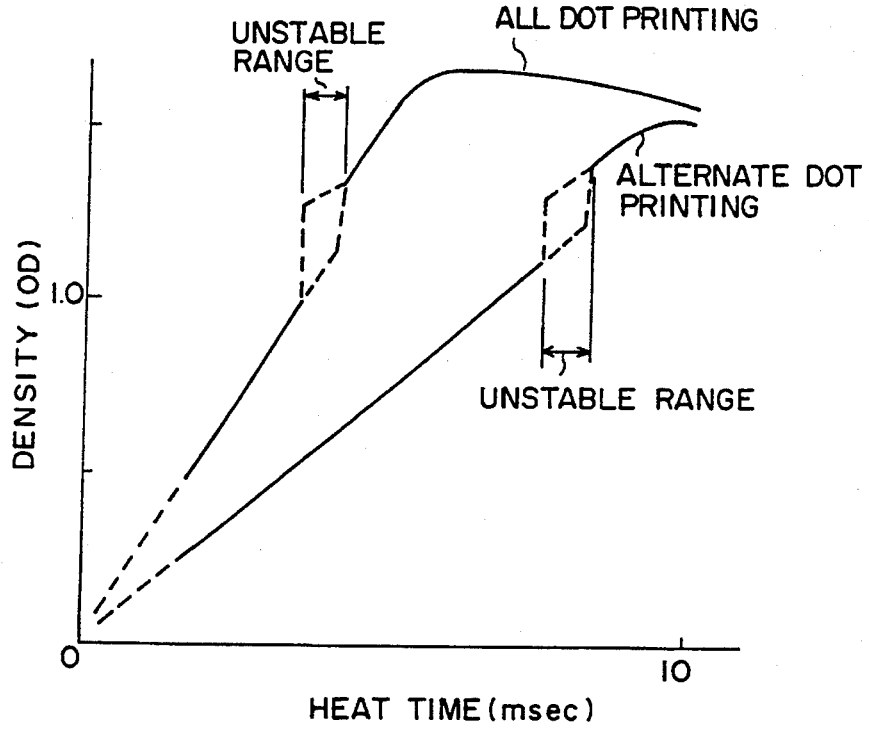
FIGS. 16A and 16B are graphical representations showing the relationship between the heating time and the ink density on the recording paper.

FIG. 16A shows the gradation characteristics, that is, the relationship between the heating time and the optical ink density (OD) of the ink on the flat-surface recording paper (e,g., coated paper) in both the cases of all dot printing and alternate dot printing; and FIG. 18B shows the same gradation characteristics, that is, the relationship between the heating time and the optical density (OD) of the ink on the porous-surface recording medium 2 in both the cases of all dot printing and alternate dot printing. The above-mentioned gradation characteristics have been obtained by experiments effected under the conditions that the maximum number of gradations ie 255; the heating time required at the maximum number of gradations is 10 msec; ; the film thickness of the ink ribbon 1 is 3.5 μm; and the quantity of ink applied onto the ink ribbon 1 is 2.0 g/m$^2$.

FIG. 16A indicates that in the case of the all dot printing by use of the flat-surface recording medium, there exists an unstable region (at which the temperature is unstable and therefore the printing density is also unstable) due to the mutual thermal interference between the two adjacent heating resistors, and further in the alternate dot printing by use of the same, there exists an unstable region (at which the two adjacent heating resistors (pixels) exert influence upon each other) due to the thermal diffusion on the surface of the recording medium. In addition, in both the cases of the all dot printing and alternate dot printing, when the heating time is as short as shown by the dashed lines (on the leftmost side) in FIG. 16A, it is difficult to fuse the ink, so that a low density printing is impossible.

Figure 16B:
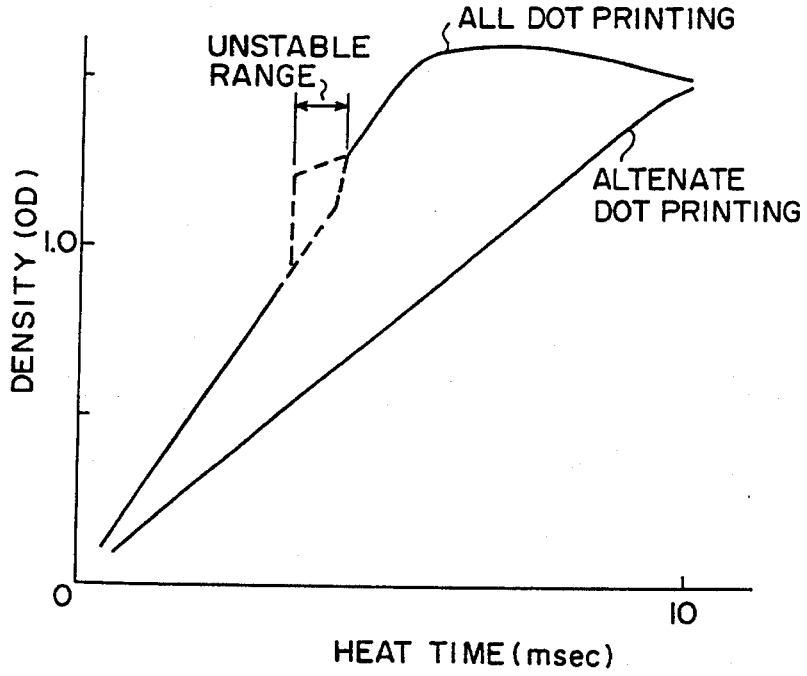

In contrast with this, FIG. 16B indicates that in the case of the porous-surface recording medium 2, although there exist an unstable region in the all dot printing, there exists no unstable region in the alternate dot printing. This is because the heat on the porous-surface layer 2*a* of the porous-surface recording medium 2 is not easily transmitted therealong. In addition, even if the heating time is short both in the all dot printing and alternate dot printing, since no thermal diffusion occurs, it is easy to fuse the ink, so that a low density printing is possible.

As described above, in the fusion-type thermal transfer printing system using the porous-surface recording medium 2 according to the present invention, even in the all dot printing, it is possible to obtain multi-gradation images of sufficiently high resolution and image quality. In the case of the alternate dot printing, it is of course possible to obtain the multi-gradation images of still higher resolution and image quality. Further, when the above-mentioned urging means for applying a large pressure onto the ink is used to permeate the ink into the pope portions of the porous-surface layer 2*a* of the recording medium 2, the alternate dot printing is not necessarily required, and it is possible to obtain multi-gradation images of extremely high resolution and image quality, even in the all dot printing.

On the other hand, the intervals of the heating resistors on the thermal heat 18 will be studied as follows: For instance, the intervals of the heating resistors of the thermal head used for a facsimile is about 8 dots. Therefore, in order to obtain multi-gradation image of high resolution and high image quality from the visual point of view, the intervals of the heating resistors of 8 dot/mm or less is required. Further, in the case of the alternate dot printing, although the resolution is deteriorated as already explained, there exists no practical problem with respect to this point, because the human visual characteristics are such that the number of gradations increases with decreasing resolution power, as is well known.

Figure 17:
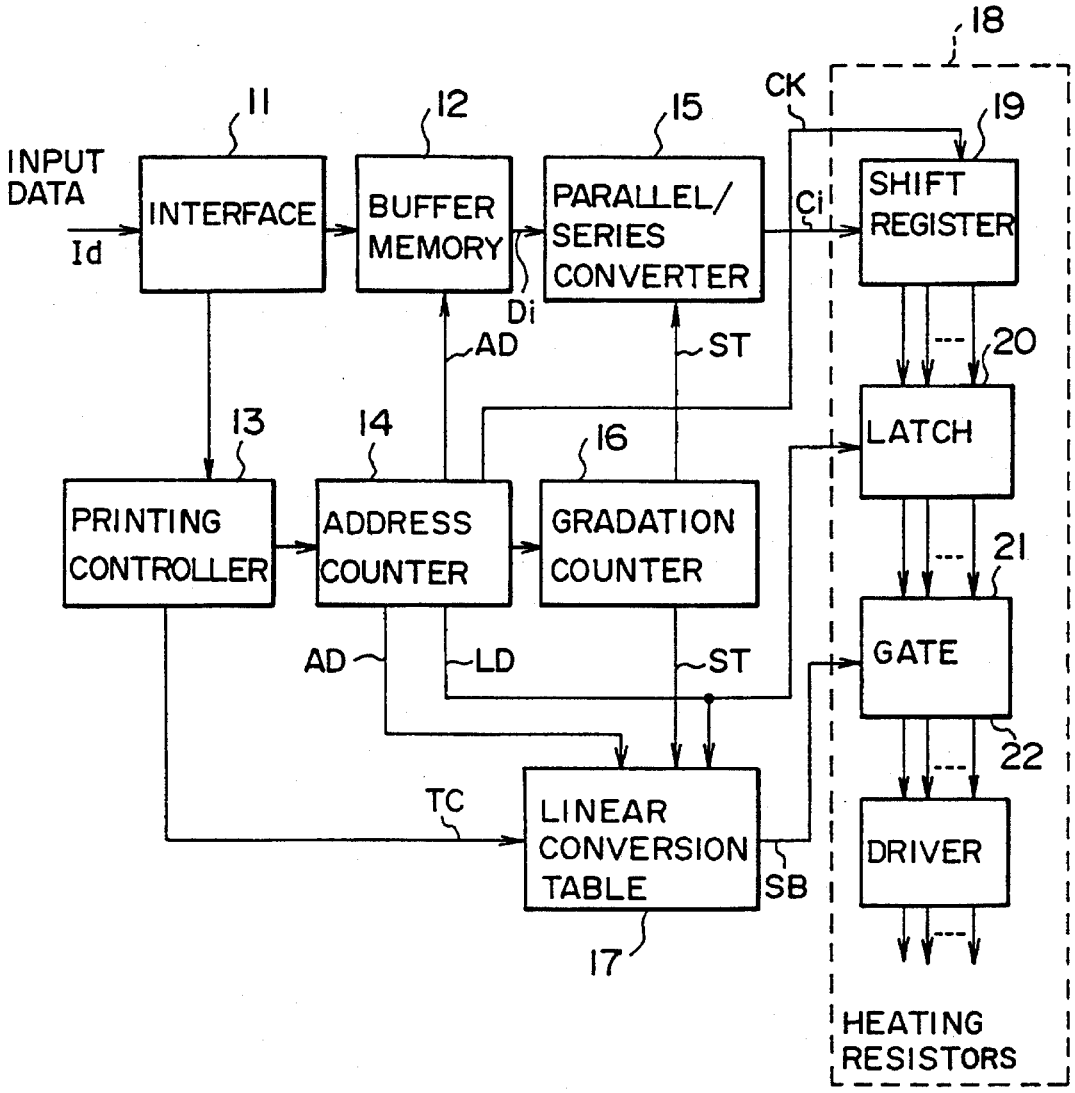
FIG. 17 is a block diagram showing an example of the gradation control circuit for the printing system according to the present invention.

An example of the configuration and the operation of a gradation control circuit incorporated in the fusion-type thermal transfer printing system will be described hereinbelow with reference to the attached drawings. The control circuit is used to control the ink fusion areas by controlling the intensity of current passed through the thermal head 18. With reference to FIG. 17, to an interface circuit 11, input data Id obtained by processing image data of an image input device such as TV camera are inputted. The input data Id include image data and control data necessary for the printing device, which represent the gradation numbers corresponding to images to be printed. The image data of the input data Id inputted to the interface circuit 11 are inputted to a buffer memory 12, and the control data thereof are inputted to a printing control circuit 13, respectively. The printing control circuit 13 generates various control signals on the basis of the operation of the printing device. Here, the printing device implies printing means composed of the thermal head 18, the ink ribbon 1, etc.

The printing control circuit 13 supplies a start signal to an address counter 14 in accordance with the operation of the printing device, and further applies a select signal TC to a linear conversion table 17 according to the operation conditions of the printing device (i.e., the color of the ink ribbon, the printing pattern to be heated, etc.). In response to the start signal, the address counter 14 generates an address AD and supplies the generated address AD to the buffer memory 12. In accordance with the address AD, the buffer memory 12 forms one-line data Di (D1 to Dn) for the thermal head 18, as shown in FIGS. 19A and 20A, on the basis of the inputted image data and then outputs the formed one-line data Di to a, parallel/series conversion circuit 15 in sequence.

Here, the one-line data Di for the thermal head 18 outputted from the buffer memory 12 will be described in more detail hereinbelow. To represent the gradation (whose gradation number is m) by use of the thermal head 18 provided with the heating resistors arranged in a line, it is necessary to apply m-stages of the quantities of heat (m-sorts of heating pulses) to the heating resistors R1 to Rn, respectively. Accordingly, in the case of the one-line data Di outputted by the buffer memory 12, data D1 to Dn corresponding to the respective heating resistors R1 to Rn are outputted in sequence from the first gradation to the m-th gradation, as shown in FIG. 20A. These data Di are outputted in sequence for each line (L1, L2, . . . ). Further, the number m of the representation gradations often used is (m=256), and therefore the present embodiment adopts the gradations whose number is 256 (from 0 to 256 densities).

The address counter 14 outputs a pulse to a gradation counter 16, whenever the one-line data Di for the thermal head 18 are read out of the buffer memory 12. On the basis of the pulses inputted to the gradation counter 16, the gradation counter 16 generates gradation signals ST and outputs the generated radiation signals ST to the parallel/series conversion circuit 15 and the linear conversion table 17, respectively. As shown in FIG. 20B, the gradation signal ST is a signal indicative of a number such as "1" when the data Di is generate for the first gradation; "2" when Di generated for the second gradation; . . . ; "m" when Di is generated for the m-th gradation.

Figures 19A, 19B, 19C, 19D, 19E, 19F:
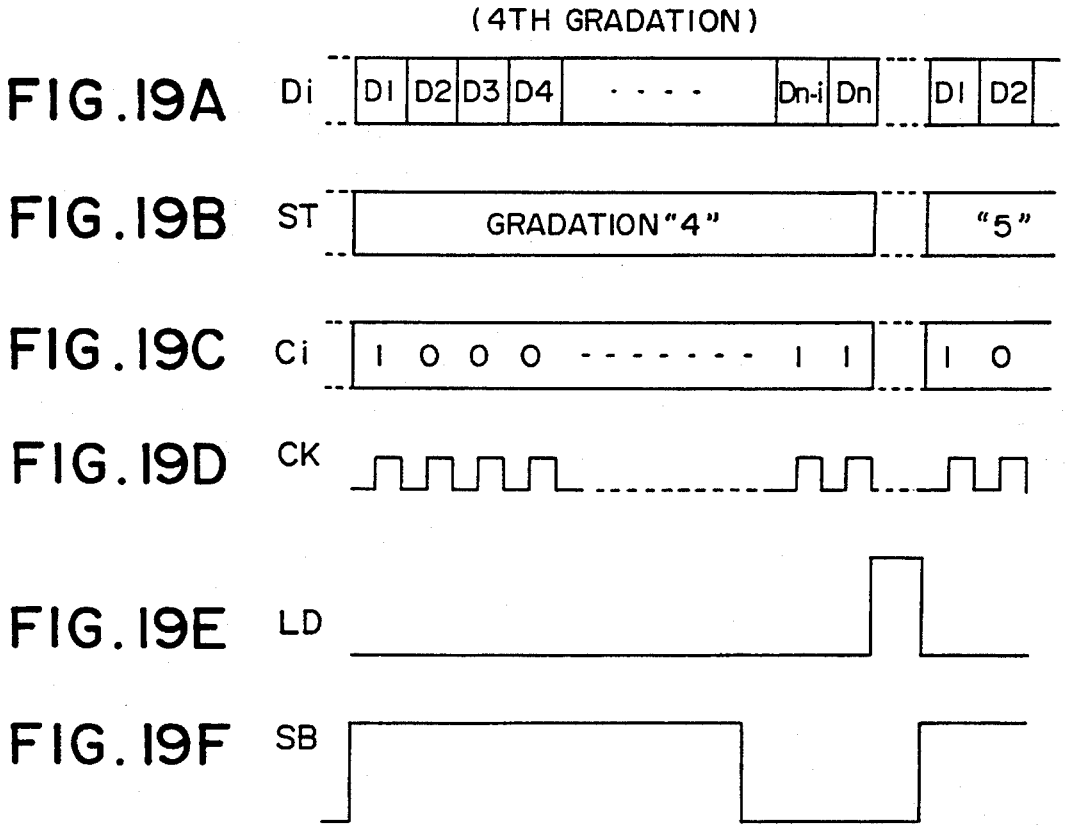
FIGS. 19A to 19F are illustrations for assistance in explaining the operation of the gradation control circuit shown in FIG. 17.
Figures 20A, 20B, 20C, 20D, 20E, 20F, 20G, 20H, 20I, 20J:
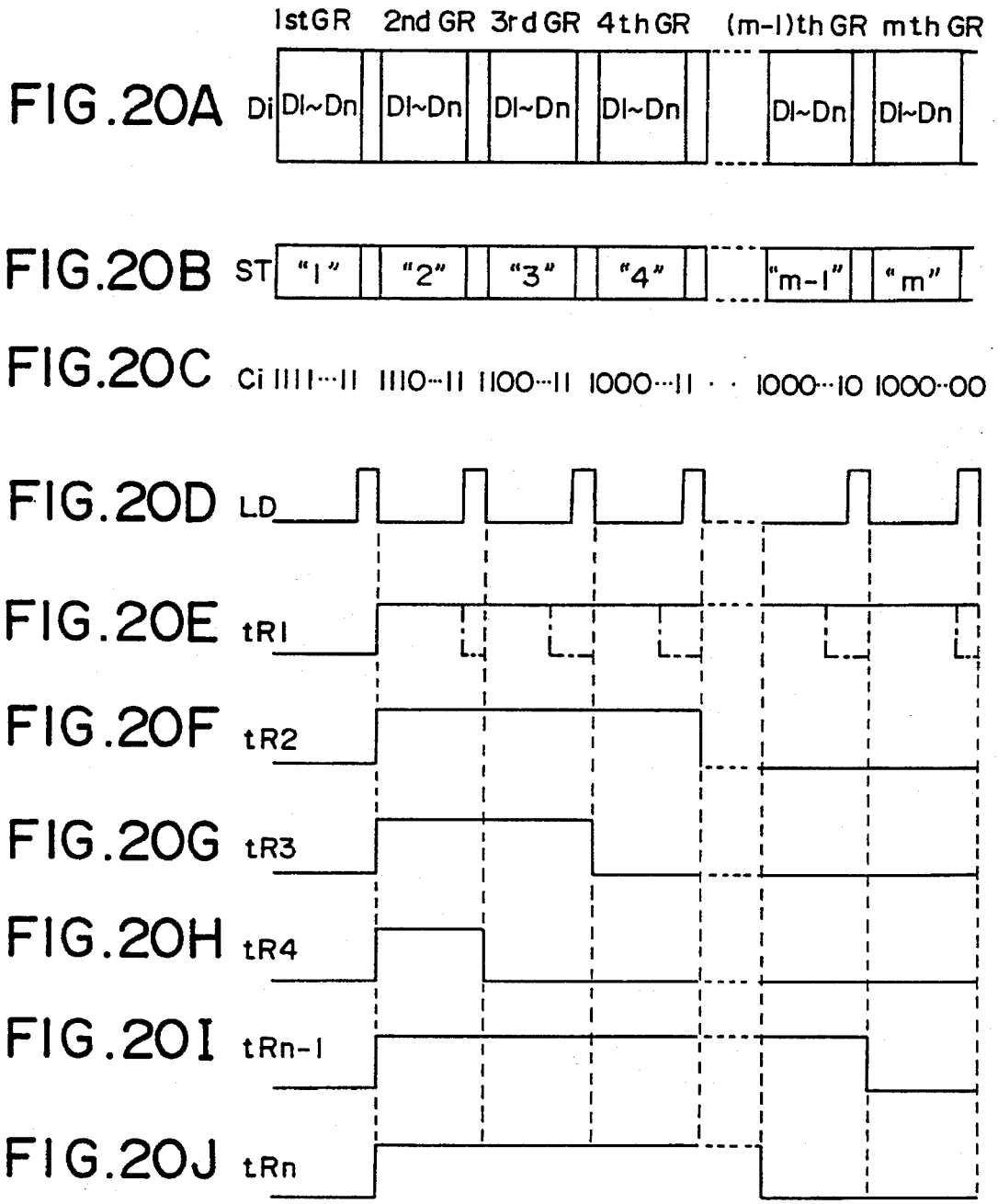
FIGS. 20A to 20J are illustrations for assistance in explaining the operation of the gradation control circuit shown in FIG. 17.

The parallel/series conversion circuit 15 compares the respective data Di (D1 to Dn) with the gradation signals ST, and generates a comparison signal Ci="1" when each data D1 to Dn is equal to or higher than the gradation signal ST (Di≧ST) and Ci="0" when each data D1 to Dn is lower than the gradation signal ST (Di≦ST), as shown in FIGS. 19C and 20C. The generated comparison signals Ci are inputted to a shift register 19 in the thermal head 18. A clock CK as shown in FIG. 19D is inputted to the shift register 19 from the address counter 14, and thereby the comparison signal Ci inputted to this shift register 19 is shifted by this clock signal CK, so that the one-line comparison signals Ci are arranged in the shift register 19. FIGS. 19 and 20 show an example in which the number of gradations are determined as D1=m, D2=3, D3=2, D4=1, . . . , Dn−1=m−2, and Dn=m−3, respectively. In the fourth gradation, since the series D1 to Dn of the gradation numbers are compared with "4", the comparison signal Ci of the fourth gradation are "1000 . . . 11", as shown in FIG. 19C.

Further, as shown in FIGS. 19E and 20E, the address counter 14 outputs a load pulse LD to a latch circuit 20 and the linear conversion table 17, whenever the one-line data Di for the thermal head 18 are read out of the buffer memory 12. The one-line comparison signals CA arranged in the shift register 19 are stored in the latch circuit 20 in response to the load pulses LD. Further, the comparison signals Ci outputted by the latch circuit 20 are inputted to a gate circuit 20.

The gate circuit 21 generates signals representative of "heating" (turn-on) and "non-heating" (turn-off) of the heating resistors R1 to Rn on the basis of the comparison signals Ci. That is, the signal represents "turn-on" when the comparison signal Ci is at "1", and "turn-on" when at "0". Therefore, the respective heating conditions of the heating resistors R1 to Rn are determined on the basis of the comparison signals Ci corresponding to the heating resistors R1 to Rn from the first gradation to m-th gradation shown in FIG. 20C. FIGS. 20F to 20J show the respective heating times tR1, tR2, tR3, tR4, tRn-1, and tRn of the respective heating resistors R1, R2, R3, R4, Rn-1 and Rn. The heating of the heating resistors R1 to Rn starts at the time point when the data Di of succeeding gradation is outputted. Therefore, the heating at the first gradation starts from the second gradation. For instance, since the comparison signals Ci of the heating resistor R1 are "1111 . . . 11", the heating resistor R1 is heated (turned on) from the first gradation to the fourth gradation, and the (m−1)-th gradation to the m-th gradation; and since the comparison signals Ci of the heating resistor R2 are "1111 . . . 00", the heating resistor R2 is heated (turned on) from the first gradation to the fourth gradation, and not heated (turned off) from the (m−1)-th gradation to the m-th gradation.

Figure 18:
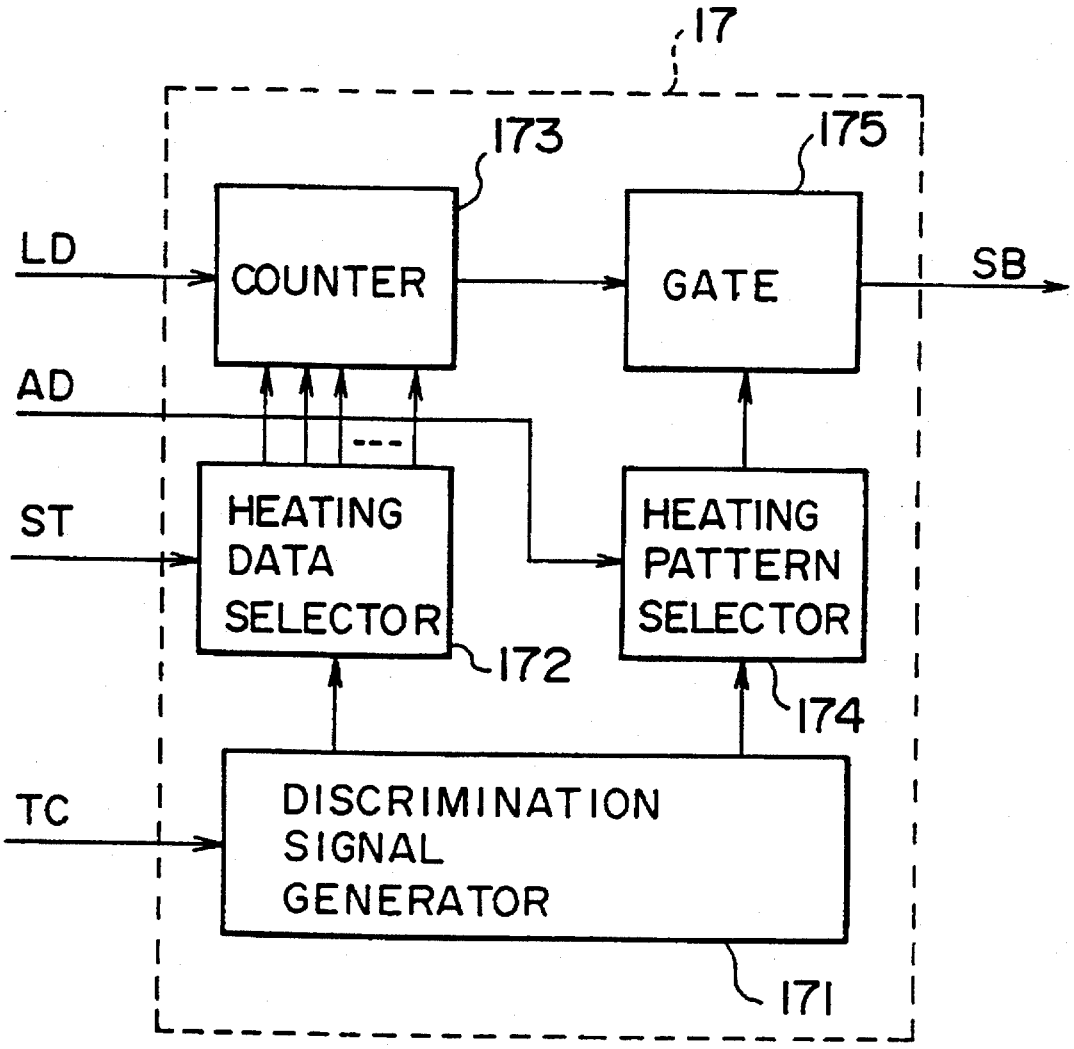
FIG. 18 is a block diagram showing a practical configuration of the linear conversion table incorporated in the control circuit shown in FIG. 17.

On the other hand, the select signal TC, the address AD, the gradation signal ST, and the load pulse LD are inputted to the linear conversion table 17, and the linear conversion table 17 outputs a heating time setting signal SB as shown in FIG. 19F. FIG. 18 shows an example of the practical configuration of this linear conversion table 17. The select signal TC is inputted to a discrimination signal generating circuit 171. The generating circuit 171 outputs a discrimination signal corresponding to the Y ink, M ink, C ink, and K ink to a heating data select circuit 172 and a heating pattern select circuit 174, respectively. The gradation signal ST is inputted to the heating data select circuit 172. The select circuit 172 outputs a count number determined for each gradation signal ST to a counter 17. The counter 173 starts counting in response to the load pulse LD to count the count number determined by the heating data select circuit 172. The address AD is inputted to the heating pattern select circuit 174. The select circuit 174 outputs a heating pattern signal as shown in FIG. 4B to the gate circuit 175. The gate circuit 175 gates the signal outputted from the counter 173 in accordance with the heating pattern, and outputs the heating time setting signal SB as shown in FIG. 19F.

Figure 21:
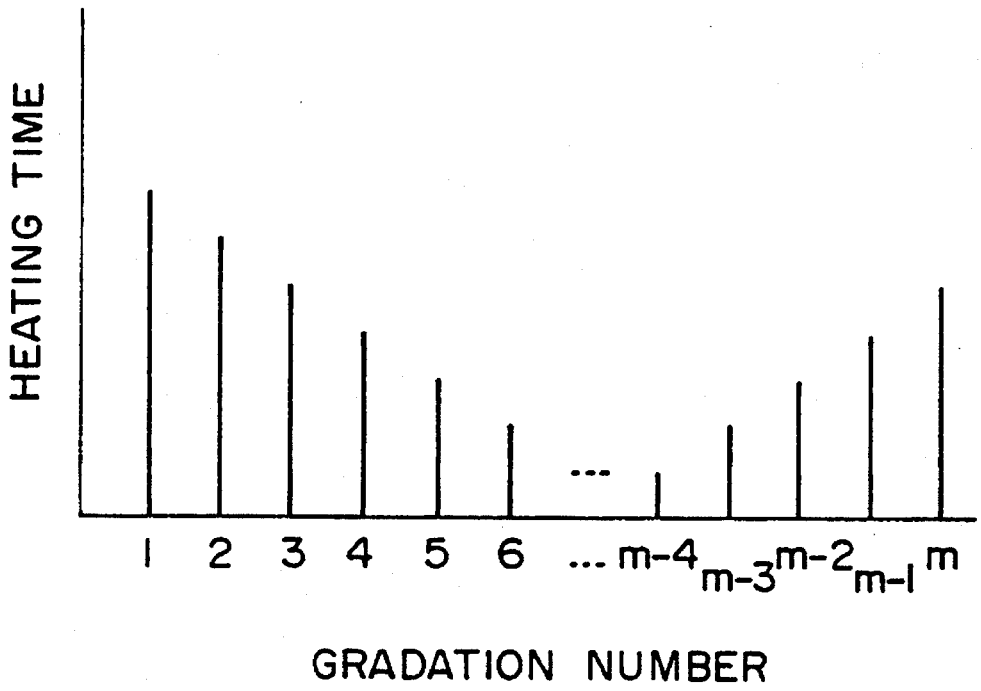
FIG. 21 is a graphical representation showing the relationship between the gradation numbers and the heating time of the printing system according to the present invention.

FIG. 21 shows the relationship between the heating time and the gradation number. The heating time from the first gradation to m-th gradation are determined so as to provide the density characteristic as linear as possible by measuring the density for each gradation. In this connection, the heat fusible ink is used at the central melting point of about 60° C. in general. Further, the count number set to the heating data select circuit 172 is determined on the basis of the heating time for each gradation as shown FIG. 21. Therefore, the turn-on time of the heating time determining signal SB outputted from the gate circuit 175 can be determined according to each gradation.

Consequently, the respective heating times tR1 to tRn of the heating resistors R1 to Rn are determined by turning on or off the heating time determining signals SB in the determined gradation. In practice, the heating resistor R1 to Rn are heated when the heating time determining signal SB is kept turned on within the heating time decided by the comparison signal Ci. For instance, the heating time of the heating resistor R1 is determined as shown by the dot-dashed lines in FIG. 20F. As described above, the respective heating times of the heating resistors R1 to Rn are determined more finely on the basis of the heating time determining signals SB from the first gradation to the m-th gradation.

The gate circuit 21 as shown in FIG. 17 generates pulses turned on during the heating times of the respective heating resistors determined on the basis of the comparison signal Ci inputed by the latch circuit 20 and the heating time determining signal SB inputted by the linear conversion table 17, and the generated pulses are supplied to a driver circuit 22. In summary, the shift resister 19, the latch circuit 20 and the gate circuit 21 serve as pulse outputting means for outputting pulses for heating the heating resistors of the thermal head 18. The driver circuit 22 passes currents through the heating resistors R1 to Rn, respectively on the basis of the pulses, to heat the ink ribbon so that the applied ink can be transferred onto the recording medium for image printing. As described above, it is possible to realize the multi-gradation representation with the use of the heat fusible ink, by finely determining the quantity of heat to be applied to the ink ribbon.

Figure 22:
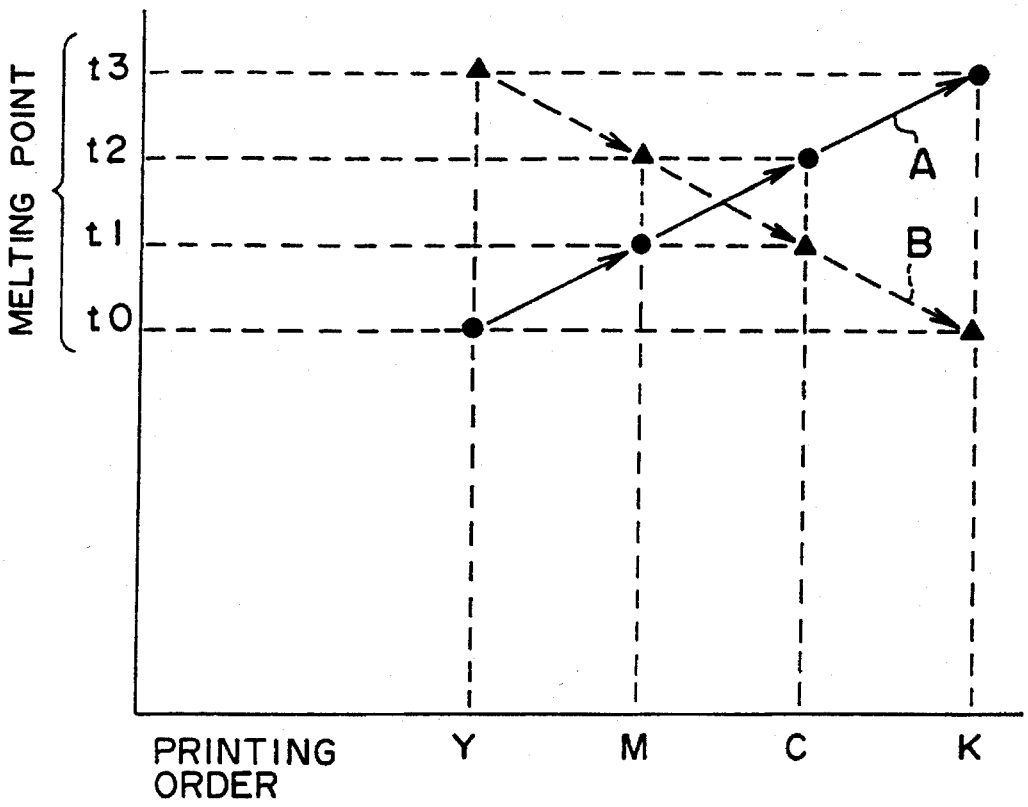
FIG. 22 is a graphical representation for assistance in explaining the printing sequence of the ink ribbon.
Figure 23A:
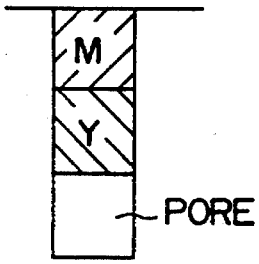
FIG. 23A and 23B are illustrations showing the states where a plurality of colors are transferred under an acceptable condition and a non-acceptable condition.
Figure 23B:
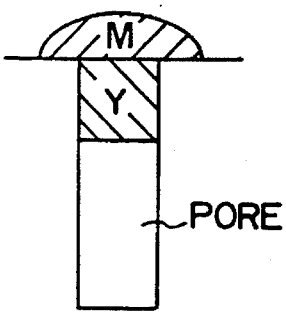

Further, in the printing with the use of a plurality of color inks, it is preferable to transfer the color inks in the order of Y, M, C and K, for instance in such a way that the melting point of the inks 1*a* increase in the printing order as shown by A in FIG. 22 (i.e., the ink of a lower melting point is transferred prior to the ink of a higher melting point. This is because the ink 1*a* transferred later melts the ink 1*a* transferred before, so that the inks 1*a* sufficiently enter the pore portions of the porous-surface recording medium 2, as shown in FIG. 23A, thus providing a stable printing condition without peeling-off. In contrast with this, when a plurality of the color inks 1*a* are transferred in the order of the inks of higher melting points, there arises a problem in that the ink 1*a* transferred later does not enter the pore portions sufficiently, as shown in FIG. 23B. In this connection, the inks 1*a* are solid at room temperature, but is required to be liquid when heated. In addition, since deformations of the thin film 1*b* of the ink ribbon 1 and the recording medium 2 must be as small as possible, it is preferable to select the ink with a melting point from 60° to 100° C.

Further, in the case where the inks are transferred in the order of Y, M, C and K, it is preferable to transfer these inks in the order of lower viscosity of the fused ink. This is because when the ink viscosity is low, the ink can enter more easily into the pore portions of the porous-surface recording medium 2. For reference, the numerical value of the viscosity of water is 1.0 cp (centi-poise), that of China-wood (tung) oil is 50 cp; and that of ricinus (castor) oil is 100 cp. Although changing according to temperature, the viscosity of the fusible inks are selected within the range from 50 to 200 cp. Accordingly, it is more preferable to transfer inks in the order of lower ink melting point and lower fusion viscosity.

As described above, in the fusion-type thermal transfer printing system according to the present invention, since the printing system comprises: an ink ribbon having a thin film and a heat fusible ink applied on the thin film at an ink application rate of 2.5 g/m$^2$ or less; a porous-surface recording medium having a substrate and a porous-surface layer formed on the substrate, diameters of pores in the porous-surface layer being from 1 to 10 μm; a thermal head provided with a plurality of heating resisters formed in a line at regular intervals of 8 dot/mm or less, temperature gradient of each of the heated heating resisters being such that temperature is the highest at a middle portion thereof and changes decreasingly toward ends thereof; and a gradation control circuit for controlling ink fusion areas heated by the heating resistors by controlling intensity of current passed through the thermal head, it is possible to obtain a multi-gradation image on the porous--surface recording medium by bringing the ink of the ink ribbon into tight contact with the porous-surface layer of the porous-surface recording medium, by urging the thermal head from the thin film side of the ink ribbon, and by controlling the ink fusion areas by the gradation control circuit.

Further, since the printing system comprises: an ink ribbon having a thin film and a heat fusible ink applied on the thin film at an ink application rate of 2.5 g/m$^2$ or less; a porous-surface recording medium having a substrate and a porous-surface layer formed on the substrate, diameters of pores in the porous-surface layer being from 1 to 10 μm; a thermal head provided with a plurality of heating resistors formed in a line at regular intervals of 8 dot/mm or less, temperature gradient of each of the heated heating resistors being such that temperature is the highest at a middle portion thereof and changes decreasingly toward ends thereof; a platen roller for sandwiching the ink ribbon and the porous-surface recording medium in cooperation with the thermal head; urging means for urging the thermal head against the platen roller under a predetermined pressure; and a gradation control circuit for controlling ink fusion areas heated by the heating resistors by controlling intensity of current passed through the thermal head, it is possible to obtain a multi-gradation image on the porous-surface recording medium by bringing the ink of the ink ribbon into tight contact with the porous-surface layer of the porous-surface recording medium; by urging the thermal head from the thin film side of the ink ribbon with the urging means under a force per unit printing length of 0.35 kg/cm or more; and by controlling the ink fusion areas of the heating resistors under control of the gradation control circuit so that, the ink permeates into the porous-surface layer of the porous-surface recording medium.

Furthermore, in the printing system comprising: an ink ribbon having a thin film and a heat fusible ink mixed with a paint and a heat fusible binder and applied on the thin film at an ink application rate of 2.5 g/m$^2$ or less, a particle diameter of the paint being Φ and an ink thickness being T; a porous-surface recording medium having a substrate and a porous-surface layer formed with a great number of pores and formed on the substrate, a diameter of the pores in the porous-surface layer being k; a thermal head provided with a plurality of heating resistors formed in a line, temperature gradient of each of the heated heating resistors being such that temperature is the highest at a middle portion thereof and changes decreasingly toward ends thereof; and a gradation control circuit for controlling ink fusion areas heated by the heating resistors by controlling intensity of current passed through the thermal head; since the printing system characterized in that the relationship among the diameter k of the pores in the porous-surface of the porous-surface recording medium, the diameter Φ of particles in the paint of the ink ribbon, and the thickness T of the applied ink is $$\Phi \leqq k \leqq 4T$$

it is possible to obtain a multi-gradation image on the porous-surface recording medium by bringing the ink of the ink ribbon into tight contact with the porous-surface layer of the porous-surface recording medium, by urging the thermal head from the thin film side of the ink ribbon, and by controlling the ink fusion areas by the gradation control circuit.

What is claimed is:

1. A fusion-type thermal transfer printing system, comprising:

an ink ribbon having a thin film and a heat fusible ink applied on the thin film at an ink application rate of 2.5 g/m$^2$ or less;

a porous-surface recording medium having a substrate and a porous-surface layer formed on the substrate, diameters of pores in the porous-surface layer being from 1 to 10 μm;

a thermal head provided with a plurality of heating resistors formed in a line at regular intervals of 8 dot/mm or less each of the heating resistors exhibiting heating characteristics such that temperature is the highest at a middle portion thereof and changes decreasingly toward ends thereof;

urging means for urging said thermal head from the thin film side of said ink ribbon so as to bring the ink of said ink ribbon into tight contact with the porous-surface layer of said porous-surface recording medium; and a gradation control circuit for controlling ink fusion areas heated by the heating resistors by controlling intensity of current passed through said thermal head to obtain a multi-gradating image on said porous-surface recording medium.

2. The fusion-type thermal transfer printing system according to claim 1, wherein on said ink ribbon, a set of plurality of color inks are applied continuously in a longitudinal direction of said ink ribbon in order of lower ink melting point, the inks on said ink ribbon being transferred in the order of lower ink melting point.

3. The fusion-type thermal transfer printing system according to claim 1, wherein on said ink ribbon, a set of plurality of color inks are applied continuously in a longitudinal direction of said ink ribbon in order of lower ink fusion viscosity, the inks on said ink ribbon being transferred in the order of lower ink fusion viscosity.

4. The fusion-type thermal transfer printing system according to claim 1, wherein on said ink ribbon, a set of plurality of color inks are applied continuously in a longitudinal direction of said ink ribbon in order of lower ink melting point and lower ink fusion viscosity, the inks on said ink ribbon being transferred in the order of lower ink melting point and lower ink fusion viscosity.

5. The fusion-type thermal transfer printing system according to claim 1, which further comprises means for heating the heating resistors of said thermal head at intervals of at least one of the heating resistors.

6. A fusion-type thermal transfer printing system, comprising:

an ink ribbon having a thin film and a heat fusible ink applied on the thin film at an ink application rate of 2.5 g/m$^2$ or less;

a porous-surface recording medium having a substrate and a porous-surface layer formed on the substrate, diameters of pores in the porous-surface layer being from 1 to 10 μm;

a thermal head provided with a plurality of heating resistors having glazed portions and formed in a line at regular intervals of 8 dot/mm or less, each of said heating resistors exhibiting heating characteristics such that temperature is the highest at a middle portion thereof and changes decreasingly toward ends thereof;

a platen roller for sandwiching said ink ribbon and said porous-surface recording medium in cooperation with said thermal head;

urging means for urging said thermal head against said platen roller under a force per unit printing length of 0.35 kg/cm or more so as to bring the ink of said ink ribbon into tight contact with the porous-surface layer of said porous-surface recording medium; and a gradation control circuit for controlling ink fusion areas heated by the heating resistors by controlling intensity of current passed through said thermal head so that the ink permeates into the porous-surface layer of said porous-surface recording medium to obtain a multi-gradation image thereon.

7. The fusion-type thermal transfer printing system according to claim 6, wherein on said ink ribbon, a set of plurality of color inks are applied continuously in a longitudinal direction of said ink ribbon in order of lower ink melting point, the inks on said ink ribbon being transferred in the order of lower ink melting point.

8. The fusion-type thermal transfer printing system according to claim 6, wherein on said ink ribbon, a set of plurality of color inks are applied continuously in a longitudinal direction of said ink ribbon in order of lower ink fusion viscosity, the inks on said ink ribbon being transferred in the order of lower ink fusion viscosity.

9. The fusion-type thermal transfer printing system according to claim 6, wherein on said ink ribbon, a set of plurality of color inks are applied continuously in a longitudinal direction of said ink ribbon in order of lower ink melting point and lower ink fusion viscosity, the inks on said ink ribbon being transferred in the order of lower ink melting point and lower ink fusion viscosity.

10. The fusion-type thermal transfer printing system according to claim 6, which further comprises means for heating the heating resistors of said thermal head at intervals of at least one of the heating resistors.

11. A fusion-type thermal transfer printing system, having:

an ink ribbon having a thin film and a heat fusible ink mixed with a paint and a heat fusible binder and applied on the thin film at an ink application rate of 2.5 g/m$^2$ or less, a particle diameter of the paint being Φ and an ink thickness being T;

a porous-surface recording medium having a substrate and a porous-surface layer formed with a great number of pores and formed on the substrate, a diameter of the pores in the porous-surface layer being k;

a thermal head provided with a plurality of heating resistors formed in a line, each of said heating resistors exhibiting heating characteristics such that temperature is the highest at a middle portion thereof and changes decreasingly toward ends thereof; and urging means for urging said thermal head from the thin film side of said ink ribbon so as to bring the ink of said ink ribbon into tight contact with the porous-surface layer of said porous-surface recording medium; and a gradation control circuit for controlling ink fusion areas heated by the heating resistors by controlling intensity of current passed through said thermal head so that the ink permeates into the porous-surface layer of said porous-surface recording medium to obtain a multi-gradation image thereon wherein the relationship among the diameter k of the pores in the porous-surface of said porous-surface recording medium, the particle diameter Φ of the paint of said ink ribbon, and the thickness T of the applied ink is $$\Phi \leq k \leq 4T.$$

12. The fusion-type thermal transfer printing system according to claim 11, wherein on said ink ribbon, a set of plurality of color inks are applied continuously in a longitudinal direction of said ink ribbon in order of lower ink melting point, the inks on said ink ribbon being transferred in the order of lower ink melting point.

13. The fusion-type thermal transfer printing system according to claim 11, wherein on said ink ribbon, a set of plurality of color inks are applied continuously in a longitudinal direction of said ink ribbon in order of lower ink fusion viscosity, the inks on said ink ribbon being transferred in the order of lower ink fusion viscosity.

14. The fusion-type thermal transfer printing system according to claim 11, wherein on said ink ribbon, a set of plurality of color inks are applied continuously in a longitudinal direction of said ink ribbon in order of lower ink melting point and lower ink fusion viscosity, the inks on said ink ribbon being transferred in the order of lower ink melting point and lower ink fusion viscosity.

15. The fusion-type thermal transfer printing system according to claim 11, which further comprises means for heating the heating resistors of said thermal head at intervals of at least one of the heating resistors.

* * * * *